US007746365B2

(12) United States Patent
Nishida

(10) Patent No.: US 7,746,365 B2
(45) Date of Patent: Jun. 29, 2010

(54) IMAGE DISPLAY DEVICE FOR ROTATING AN IMAGE DISPLAYED ON A DISPLAY SCREEN

(75) Inventor: Michiya Nishida, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 791 days.

(21) Appl. No.: 11/110,835

(22) Filed: Apr. 21, 2005

(65) Prior Publication Data

US 2005/0237346 A1 Oct. 27, 2005

(30) Foreign Application Priority Data

Apr. 22, 2004 (JP) ..... 2004-126838

(51) Int. Cl.
*G09G 5/02* (2006.01)

(52) U.S. Cl. ..... 345/697; 345/694

(58) Field of Classification Search ..... 345/697, 345/690, 211, 168, 156, 161, 571, 656, 545, 345/87, FOR. 146, 173, 419, 649, 31, 4–9; 361/683, 681; 348/837, 727, 333.03; 382/194; 273/348; 318/640; 374/124; 250/221; 715/728; 378/4; 359/479, 676
See application file for complete search history.

(56) References Cited

U.S. PATENT DOCUMENTS 4,746,224 A * 5/1988 Mizuno et al. ..... 374/124
4,763,903 A * 8/1988 Goodwin et al. ..... 273/371
4,818,859 A * 4/1989 Hough ..... 250/221
4,949,972 A * 8/1990 Goodwin et al. ..... 273/371
5,148,310 A * 9/1992 Batchko ..... 359/479
5,250,888 A * 10/1993 Yu ..... 318/640
5,422,653 A * 6/1995 Maguire, Jr. ..... 345/9
5,479,185 A * 12/1995 Biverot ..... 345/6
5,644,324 A * 7/1997 Maguire, Jr. ..... 345/9
5,644,653 A * 7/1997 Sunakawa et al. ..... 382/187
5,663,740 A * 9/1997 Brotz ..... 345/31
5,748,382 A * 5/1998 Maguire, Jr. ..... 359/676

(Continued)

FOREIGN PATENT DOCUMENTS

JP 06-102994 4/1994

(Continued)

OTHER PUBLICATIONS

Japanese Office Action dated Nov. 7, 2007 with partial English translation.

(Continued)

*Primary Examiner*—Prabodh M Dharia
(74) *Attorney, Agent, or Firm*—McGinn IP Law Group, PLLC

(57) ABSTRACT

An image display device comprises a frame arranged along the periphery of display screen and a plurality of detectors mounted on the frame, each for generating a detection signal in response to an object positioned outside of the frame. Each of detectors generates a detection signal indicative of the distance to an object that is present in a direction associated therewith. A control circuit selects a detection signal indicative of the shortest distance of the detection signals. The control circuit controls the direction of an image that is displayed on a display screen such that the bottom of the image is moved to a side corresponding to the detector that generates the selected detection signal.

14 Claims, 3 Drawing Sheets

U.S. PATENT DOCUMENTS

| | | | | |
|---|---|---|---|---|
| 5,835,083 | A * | 11/1998 | Nielsen et al. | 345/211 |
| 5,986,634 | A * | 11/1999 | Alioshin et al. | 345/649 |
| 5,988,645 | A * | 11/1999 | Downing | 273/348 |
| 6,100,538 | A * | 8/2000 | Ogawa | 250/559.29 |
| 6,100,862 | A * | 8/2000 | Sullivan | 345/88 |
| 6,111,597 | A * | 8/2000 | Tabata | 348/43 |
| 6,124,838 | A * | 9/2000 | Lasko-Harvill et al. | 345/8 |
| 6,137,456 | A * | 10/2000 | Bhagavatula et al. | 345/7 |
| 6,172,657 | B1 * | 1/2001 | Kamakura et al. | 345/8 |
| 6,246,382 | B1 * | 6/2001 | Maguire, Jr. | 345/8 |
| 6,307,589 | B1 * | 10/2001 | Maquire, Jr. | 348/333.03 |
| 6,377,238 | B1 * | 4/2002 | McPheters | 345/156 |
| 6,441,362 | B1 * | 8/2002 | Ogawa | 250/221 |
| 6,501,856 | B2 * | 12/2002 | Kuwano et al. | 382/194 |
| 6,606,130 | B1 * | 8/2003 | George | 348/744 |
| 6,765,566 | B1 * | 7/2004 | Tsao | 345/419 |
| 6,942,489 | B2 * | 9/2005 | Tiesler | 439/34 |
| 6,961,051 | B2 | 11/2005 | Weindorf et al. | 345/175 |
| 7,129,931 | B2 * | 10/2006 | Pappas | 345/168 |
| 7,164,117 | B2 * | 1/2007 | Breed et al. | 250/221 |
| 7,205,991 | B2 | 4/2007 | Fitzmaurice et al. | 345/419 |
| 7,280,166 | B2 * | 10/2007 | Nagata et al. | 348/837 |
| 7,439,940 | B1 * | 10/2008 | Maguire, Jr. | 345/7 |
| 2002/0149613 | A1 | 10/2002 | Gutta et al. | 345/728 |
| 2002/0163482 | A1 * | 11/2002 | Sullivan | 345/6 |
| 2003/0142092 | A1 | 7/2003 | Fitzmaurice et al. | 345/419 |
| 2003/0161435 | A1 | 8/2003 | Ozaki | 378/4 |
| 2004/0118987 | A1 * | 6/2004 | Matko et al. | 248/282.1 |
| 2004/0145575 | A1 | 7/2004 | Weindorf et al. | 345/173 |
| 2004/0164956 | A1 | 8/2004 | Yamaguchi et al. | 345/156 |
| 2005/0046584 | A1 * | 3/2005 | Breed | 340/825.72 |
| 2006/0077212 | A1 | 4/2006 | Fitzmaurice et al. | 345/653 |
| 2006/0208169 | A1 * | 9/2006 | Breed et al. | 250/221 |
| 2006/0268008 | A1 * | 11/2006 | Idesawa et al. | 345/623 |
| 2007/0097319 | A1 * | 5/2007 | McKay et al. | 353/7 |
| 2007/0100666 | A1 * | 5/2007 | Stivoric et al. | 705/3 |

FOREIGN PATENT DOCUMENTS

| | | |
|---|---|---|
| JP | 09-037187 | 2/1997 |
| JP | 10-319898 | 12/1998 |
| JP | 2000-132304 | 5/2000 |
| JP | 2000-163179 | 6/2000 |
| JP | 2001-075546 | 3/2001 |
| JP | 2001-350588 | 12/2001 |
| JP | 2002-132242 | 5/2002 |
| JP | 2003-060940 | 2/2003 |
| JP | 2003-274366 | 9/2003 |
| JP | 2004-036292 | 2/2004 |
| JP | 2005-501400 | 1/2005 |
| JP | 2006-503341 | 1/2006 |
| WO | 02/093703 | 11/2002 |
| WO | 2004-036292 | 4/2004 |

OTHER PUBLICATIONS

Japanese Office Action dated May 7, 2008 with partial English translation.

* cited by examiner

IMAGE DISPLAY DEVICE FOR ROTATING AN IMAGE DISPLAYED ON A DISPLAY SCREEN

BACKGROUND OF THE INVENTION

1. Field of the Invention

The present invention relates to an image display device, and more particularly, to an image display device that can change the direction of an image, for example, rotate the image displayed on a display screen.

2. Description of the Related Art

Conventionally, a certain image display device is known to control the direction of an image displayed on its display screen such that the bottom of the displayed image is positioned at a vertically lower position of the display screen even if the display screen is rotated.

JP-2003-60940-A and JP-2003-274366-A each describe an electronic camera for controlling the direction of an image displayed on a display screen.

The electronic camera detects the posture of the electronic camera by a camera posture detector. The electronic camera records the detected posture together with an image captured by the electronic camera. Upon reproduction of the recorded image on a display screen, the electronic camera controls the direction of the image displayed on the display screen based on the detected posture that is recorded together with the image. A gravity sensor is used as the camera posture detector (see JP-2003-274366-A).

JP-H9-37187-A describes an image display device that rotates an image displayed on its display screen.

This image display device detects the posture of a user who is watching an image displayed on the image display device, instead of the posture of the image display device itself, by an infrared sensor. The image display device rotates the image displayed on the display screen by 90° when the user is sprawling. The infrared sensor senses a region in front of the display screen.

Japanese Patent No. 3013808 describes techniques for scaling up and down an image represented by an image signal.

When a gravity sensor detects the posture of an image display device as described in JP-2003-60940-A and JP-2003-274366-A, the following problems can arise.

When an image display device is installed such that its display screen is substantially horizontal to the ground surface, the result that is detected by the gravity sensor doesn't indicate the position of the user who is viewing the display screen. Therefore, the gravity sensor cannot always correctly detect the position of the user who is viewing the display screen. Accordingly, when the image display device is installed such that the display screen is substantially horizontal to the ground surface, the image display device cannot rotate a displayed image so that the user can easily watch the displayed image.

In addition, the gravity sensor cannot detect the posture of the image display device in a weightless environment such as a space station.

The image display device described in JP-H9-37187-A can arise the following problems, because the infrared sensor that is included in the image display device has a detectable region in front of the display screen.

When the image display device is installed such that the display screen is substantially horizontal to the ground surface, and when the user is watching an image displayed thereon at a position out of the front of the displayed image, the infrared sensor cannot always correctly detect the position of the user who is watching the displayed image.

FIG. 1 is an explanatory diagram illustrating an exemplary situation in which image display device 101 is installed such that display screen 102 of image display device 101 is substantially horizontal to the ground surface, and when user 201 is viewing display screen 102 at a position out of the front of display screen 102 (specifically at a position beside display screen 102).

Infrared sensor 103 has a detectable region in front of display screen 102. Therefore, in the state illustrated in FIG. 1, infrared sensor 103 cannot detect user 201. Consequently, image display device 101 cannot control the direction of an image such that the user 201 can easily watch the displayed image.

SUMMARY OF THE INVENTION

It is an object of the present invention to provide an image display device that is capable of adjusting the direction of an image that is displayed on a display screen such that the user can easily watch the displayed image even if the image display device is installed such that the display screen is substantially horizontal to the ground surface.

To achieve the object, an image display device includes a display unit having a display screen for displaying an image, a frame arranged along the periphery of the display screen, a plurality of detectors mounted on the frame, each for generating a detection signal in accordance with an object positioned outside of the frame, and a controller for controlling an image displayed on the display screen based on the detection signals generated from the respective detectors.

According to the image display device described above, an image displayed on the display screen is controlled based on the detection signals generated from the respective detectors. Each detector generates a detection signal in response to an object that is positioned outside the frame. Therefore, each detector can detect an object that exists beside the display screen. Consequently, the image, which is displayed on the display screen, is changed based on the result of detecting the object that exists beside the display screen.

Thus, the image display device can automatically display on the display screen an image that the user can easily watch, even when the image display device is installed such that the display screen is substantially horizontal to the ground surface.

Preferably, the display screen is in a rectangular shape, and the plurality of detectors include four detectors each mounted at a location on the frame close to each of four sides of the display screen.

According to the image display device described above, an image displayed on the display screen can be controlled based on the result of comparing the detection signals generated from the four detectors.

Also preferably, the display screen is in a rectangular shape, and the plurality of detectors include three detectors each mounted at a location on the frame close to each of three sides of the display screen.

According to the image display device described above, the configuration can be simplified as compared with the image display device that employs four detectors.

Further preferably, the display screen is in a rectangular shape, and the plurality of detectors comprise two detectors each mounted at a location on the frame close to any of two sides of the display screen.

According to the image display device described above, the configuration can be further simplified as compared with the image display device that employs three detectors.

Preferably, the controller detects a side, to which the user is close, from sides that define the display screen based on the detection signals that are generated from the plurality of detectors, and controls the direction of the image such that the bottom of the image is moved to the detected side.

According to the image display device described above, the image display device can automatically display on the display screen an image that the user can easily watch, even if the image display device is installed such that the display screen is moved in whichever direction.

Each of the detectors is preferably a radiant heat sensor for detecting the amount of heat radiated from an object in order to generate a signal, which indicates the detected amount of radiant heat, as the detection signal.

Alternatively, each of the detectors is preferably a distance sensor.

Preferably, the image display device further includes an image signal input unit for receiving an image signal that is supplied from an external device through a wire, wherein the controller converts the image signal based on the detection signals generated from the respective detectors in order to control the direction of an image, which is represented by the received image signal, on the display screen, and displays an image represented by the converted image signal on the display screen.

Also preferably, the image display device further includes storing means for preserving an image signal received by the image signal input unit.

The image display device is preferably configured such that the storing means is removable.

Preferably, the image display device further includes a generator for generating an image signal that represents the image, wherein the controller converts the image signal generated by the generator based on the detection signals generated from the respective detectors in order to control the direction of an image, which is represented by the generated image signal, on the display screen, and displays an image represented by the converted image signal on the display screen.

According to the present invention, the image display device can detect an object that exists beside the display screen, and change the direction of an image displayed on the display screen based on the result of the detection. Therefore, even if the image display device is installed, for example, such that the display screen is substantially horizontal to the ground surface, the image display device can automatically display on the display screen an image that the user can easily watch.

The above and other objects, features, and advantages of the present invention will become apparent from the following description with reference to the accompanying drawings which illustrate examples of the present invention.

DETAILED DESCRIPTION OF THE EMBODIMENTS

Figure 2:
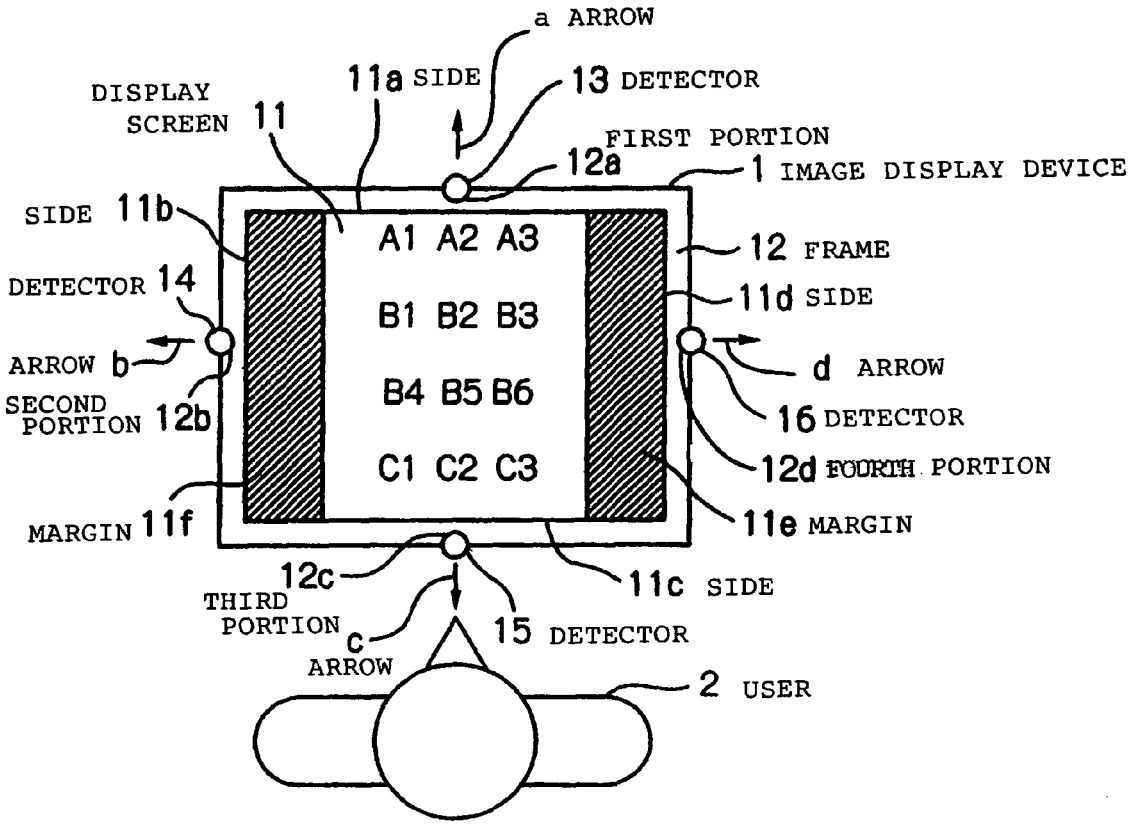
FIG. 2 is a plan view illustrating an image display device according to one embodiment of the present invention.

FIG. 2 is a plan view illustrating from above a situation in which image display device 1 is installed on a desk (not shown), and user 2 is watching an image displayed on image display device 1.

In FIG. 2, image display device 1 comprises display screen 11, frame 12, and detectors 13-16.

Image display device 1 is preferably a highly portable thin image display device which utilizes a flat panel, for example, a liquid crystal display (LCD), a plasma display (PDP) or the like. Highly portable thin image display devices are used for display devices of notebook type personal computers or display devices of electronic books. A variety of manners can be expected in the utilization of the highly portable thin image display devices. For example, as illustrated in FIG. 2, a highly portable thin image display device may be installed on a desk so that its display screen is substantially in parallel with the ground surface.

Image display device 1 is not limited to such a highly portable thin image display device utilizing a flat panel.

Display screen 11 is defined by sides 11*a*, 11*b*, 11*c* and 11*d*. Side 11*a* is an example of a first side. Side 11*b* is an example of a second side. Side 11*c* is an example of a third side. Side 11*d* is an example of a fourth side. Display screen 11 displays an image represented by an image signal.

In this embodiment, display screen 11 is in a rectangular shape. Specifically, sides 11*a*, 11*c* are parallel and equal in length to each other, while sides 11*b*, 11*d* are parallel and equal in length to each other, with an angle of 90° formed by sides 11*a* and 11*b*. The shape of display screen 11 is not limited to a rectangle, but may be changed as appropriate.

Frame 12 is disposed around the periphery of display screen 11.

Detector 13 is an example of a first detector. Detector 13 may be, for example, a radiant heat sensor such as an infrared sensor, or a distance sensor.

The distance sensor, which is used as detector 13, measures the distance to an object, for example, based on a time period from a time, which an ultrasonic wave is emitted from the sensor, to a time, which a reflected wave of the ultrasonic wave returns thereto. The distance sensor used as detector 13 is not limited to a sensor utilizing ultrasonic waves, but may be changed as appropriate. The distance sensor is only required to generate a distance signal (first detection signal) that indicates the distance to an object.

The radiant heat sensor, which is used as detector 13, preferably has characteristics to generate a higher output voltage that indicates the amount of radiant heat detected thereby when the sensor detects a larger amount of radiant heat. In this event, detector 13 generates a higher output voltage (first detection signal) when a human, who is an object, is closer to detector 13.

Detector 13 is mounted in first portion 12*a* on frame 12 in close proximity to side 11*a*. Detector 13 has a detectable region outside of frame 12 around first portion 12*a* (for example, in a direction indicated by arrow a shown in FIG. 2). Detector 13 generates a first detection signal in response to an object that exists within its detectable region. Detector 13 is corresponded to side 11*a*.

Sensor 14 is an example of a second sensor. Sensor 14 is, for example, a radiant heat sensor such as an infrared sensor, or a distance sensor.

The distance sensor, which is used as detector 14, measures the distance to an object based on a time period from a time, which an ultrasonic wave is emitted from the sensor, to a time, which a reflected wave of the ultrasonic wave returns thereto. The distance sensor used as detector 14 is not limited to a sensor utilizing ultrasonic waves, but can be changed as appropriate. The distance sensor is only required to generate a distance signal (second detection signal) indicative of the distance to an object.

Also, the radiant heat sensor, which is used as detector 14, preferably has characteristics to generate a higher output voltage that indicates the amount of radiant heat detected thereby when the sensor detects a larger amount of radiant heat. In this event, detector 14 generates a higher output voltage (second detection signal) when a human, who is an object, is closer to detector 14.

Detector 14 is mounted in second portion 12*b* on frame 12 in close proximity to side 11*b*. Detector 14 has a detectable region outside of frame 12 around second portion 12*b* (for example, in a direction indicated by arrow b shown in FIG. 2). Detector 14 generates a second detection signal in response to an object that exists within its detectable region. Detector 14 is corresponded to side 11*b*.

Sensor 15 is an example of a third sensor. Sensor 15 is, for example, a radiant heat sensor such as an infrared sensor, or a distance sensor.

The distance sensor, which is used as detector 15, measures the distance to an object based on a time period from a time, which an ultrasonic wave is emitted from the sensor, to a time, which a reflected wave of the ultrasonic wave returns thereto. The distance sensor, which is used as detector 15 is not limited to a sensor utilizing ultrasonic waves, but can be changed as appropriate. The distance sensor is only required to generate a distance signal (third detection signal) indicative of the distance to an object.

Also, the radiant heat sensor, which is used as detector 15, preferably has characteristics to generate a higher output voltage that indicates the amount of radiant heat detected thereby when the sensor detects a larger amount of radiant heat. In this event, detector 15 generates a higher output voltage (third detection signal) when a human, who is an object, is closer to detector 15.

Detector 15 is mounted in third portion 12*c* on frame 12 in close proximity to side 11*c*. Detector 15 has a detectable region outside of frame 12 around third portion 12*c* (for example, in a direction indicated by arrow c shown in FIG. 2). Detector 15 generates a third detection signal in response to an object that exists within its detectable region. Detector 15 is corresponded to side 11*c*.

Sensor 16 is an example of a fourth sensor. Sensor 16 is, for example, a radiant heat sensor such as an infrared sensor, or a distance sensor.

The distance sensor, which is used as detector 16, measures the distance to an object based on a time period from a time, which an ultrasonic wave is emitted from the sensor, to a time, which a reflected wave of the ultrasonic wave returns thereto. The distance sensor, which is used as detector 16, is not limited to a sensor utilizing ultrasonic waves, but can be changed as appropriate. The distance sensor is only required to generate a distance signal (fourth detection signal) that indicates the distance to an object.

Also, the radiant heat sensor, which is used as detector 16, preferably has characteristics to generate a higher output voltage that indicates the amount of radiant heat detected thereby when the sensor detects a larger amount of radiant heat. In this event, detector 16 generates a higher output voltage (fourth detection signal) when a human, who is an object, is closer to detector 16.

Detector 16 is mounted in fourth portion 12*d* on frame 12 in close proximity to side 11*d*. Detector 16 has a detectable region outside of frame 12 around fourth portion 12*d* (for example, in a direction indicated by arrow d shown in FIG. 2). Detector 16 generates a fourth detection signal in response to an object that exists within its detectable region. Detector 16 is corresponded to side 11*d*.

Sensors 13, 14, 15, 16 are preferably of the same type.

Figure 3:
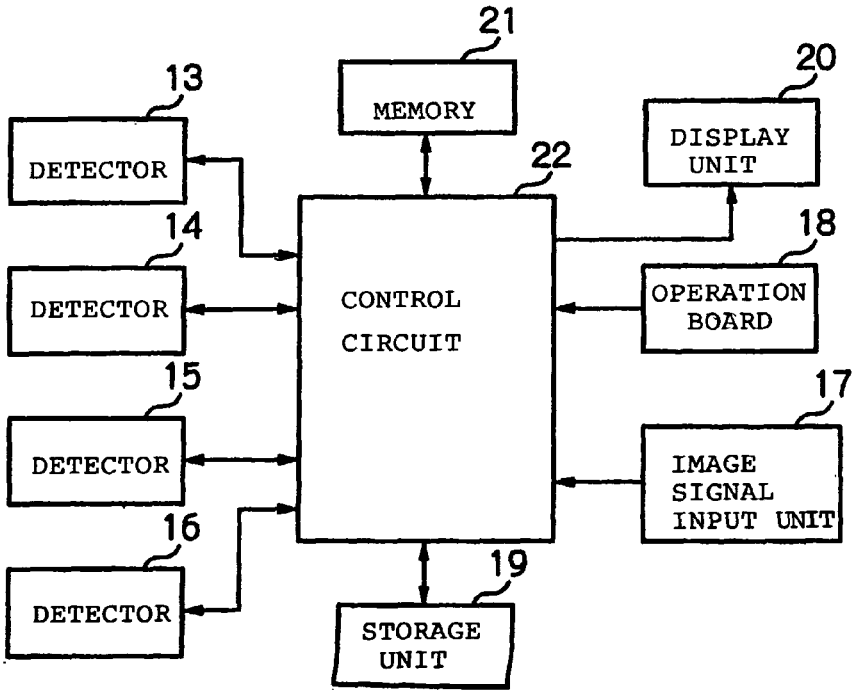
FIG. 3 is a block diagram illustrating the image display device according to the embodiment of the present invention.

In FIG. 3, components identical to those shown in FIG. 2 are designated the same reference numerals.

In FIG. 3, image display device 1 comprises sensor 13-16, image signal input unit 17, operation board 18, storage unit 19, display unit 20, memory 21, and control circuit 22.

Image signal input unit 17 receives an image signal that represents an image. For example, image signal input unit 17 includes an antenna (not shown). Image signal input unit 17 receives an image signal transmitted over the air from an external radio transmitter through its antenna. Also, image signal input unit 17 also includes an input terminal (not shown). When the input terminal is connected to a cable that provides an image signal, image signal input unit 17 receives an image signal that is supplied from an external device such as a personal computer through the cable.

Operation board 18 is operated by the user. Operation board 18 receives a variety of inputs indicated by the user's operations.

Storage unit 19 includes a recording medium such as DVD (Digital Versatile Disk). Storage unit 19 preserves image signals received by image signal input unit 17. Storage unit 19 is preferably removable from image display device 1.

Display unit 20 has display screen 11 shown in FIG. 2. Display unit 20 displays on display screen 11 an image that is represented by an image signal supplied from control circuit 22.

Memory 21 is a recording medium readable by a computer. Memory 21 records a program for defining the operation of image display device 1.

Controller 22 includes a CPU that is an example of computer. Control circuit 22 reads the program recorded in memory 21. Control circuit 22 executes the read program to perform a variety of operations. For example, control circuit 22 generates an image signal, which indicates an image, based on entries from the user received by operation board 18, like a personal computer, an electronic databook or the like. Control circuit 22 may store the generated image signal in storage unit 19. Control circuit 22 may also store an image signal received by image signal unit 17 in storage unit 19. Control circuit 22 preferably stores an image signal received by image signal input unit 17 in storage unit 19 when the user operates operation board 18 in order to enter a storage command.

Control circuit 22 also receives the first detection signal generated from detector 13; the second detection signal generated from detector 14; the third detection signal generated from detector 15; and the fourth detection signal generated from detector 16. Control circuit 22 controls the direction of an image, which is displayed on display screen 11 of display unit 20, based the first, second, third, and fourth detection signals.

Specifically, control circuit 22 converts an image signal, which is generated based on an entry from the user received by operation board 18, based on the first, second, third, and fourth detection signals such that an image, which is displayed on display screen of display unit 20, is changed in direction.

Control circuit 22 also converts an image signal, which is received by image signal input unit 17, based on the first, second, third, and fourth signals such that an image displayed on display screen 11 of display unit 20 is change in direction.

Control circuit 22 further converts an image signal, which is preserved in storage unit 19, based on the first, second, third, and fourth detection signal such that an image displayed on display screen 11 of display unit 20 is changed in direction.

Control circuit 22 displays the image, which is represented by the converted image signal, on display screen 11 of display unit 20.

Control circuit 22 selects a detection signal, which satisfies predetermined conditions, from the first, second, third, and fourth signals. For example, control circuit 22 selects a detection signal that indicates the highest output voltage when detectors 13-16 comprise radiant heat sensors. Alternatively, control circuit 22 selects a detection signal that indicates the shortest distance when detectors 13-16 comprise distance sensors.

Controller 22 preferably controls the direction of the image such that the bottom of the image is moved to a side corresponding to a detector that has generated the selected detection signal.

Next, the operation will be described.

Control circuit 22 operates detectors 13, 14, 15 and 16 at predetermined time intervals, for example, when image display device 1 is powered on. Alternatively, control circuit 22 may operate detectors 13, 14, 15 and 16 when the user operates operation board 18 in order to enter a detection start command.

Detector 13, which has started the operation, supplies control circuit 22 with a first detection signal in accordance with an object that exists in its detectable region. Detector 14, which has started the operation, supplies control circuit 22 with a second detection signal in accordance with an object that exists in its detection region. Detector 15, which has started the operation, supplies control circuit 22 with a third detection signal in accordance with an object that exists in its detectable region. Detector 16, which has started the operation, supplies control circuit 22 with a fourth detection signal in accordance with an object that exists in its detection region.

Control circuit 22 compares the first, second, third, and fourth detection signals with one another. Subsequently, control circuit 22 selects a detection signal, which satisfies predetermined conditions, from the first, second, third, and fourth detection signal. For example, control circuit 22 selects a detection signal that indicates the highest output voltage when detectors 13-16 comprise radiant heat sensors. On the other hand, control circuit 22 selects a detection signal that indicates the shortest distance when detectors 13-16 comprise distance sensors.

For example, in the state illustrated in FIG. 2, control circuit 22 selects the third detection signal from the first, second, third, and fourth detection signals. Control circuit 22 converts an image signal for display unit 20 such that the bottom of an image is moved to a side corresponding to the detector that has generated the selected detection signal.

The image signal for display unit 20 may be an image signal received by image signal input unit 17, or an image signal stored in storage unit 19, or an image signal generated by control circuit 22.

For example, in the state illustrated in FIG. 2, control circuit 22 displays the image such that the bottom of the image is moved to side 11*c* corresponding to detector 15 that has generated the third detection signal.

In this embodiment, control circuit 22 scales up or down the image represented by the image signal such that the overall image (for example; the overall image having the area of one page), which is represented by the image signal, is fitted in display screen 11 in a sufficient size.

For example, control circuit 22 scales up or down the image represented by the image signal such that the size of the overall image (for example, the overall image having the area of one page), which is represented by the image signal, is the largest one of images sizes which fit in display screen 11. Control circuit 22 may employ, for example, the technique described in JP-9-37187-A when it scales up or down an image signal.

In the state illustrated in FIG. 2, control circuit 22 compresses a rectangular document (image) with more height than width such that the rectangular document with more height than width fits in rectangular display screen 11 with more width than height. Control circuit 22 displays the compressed document (image) on display unit 20. For this reason, display screen 11 shown in FIG. 2 includes margins 11*e* and 11*f*.

Figure 4:
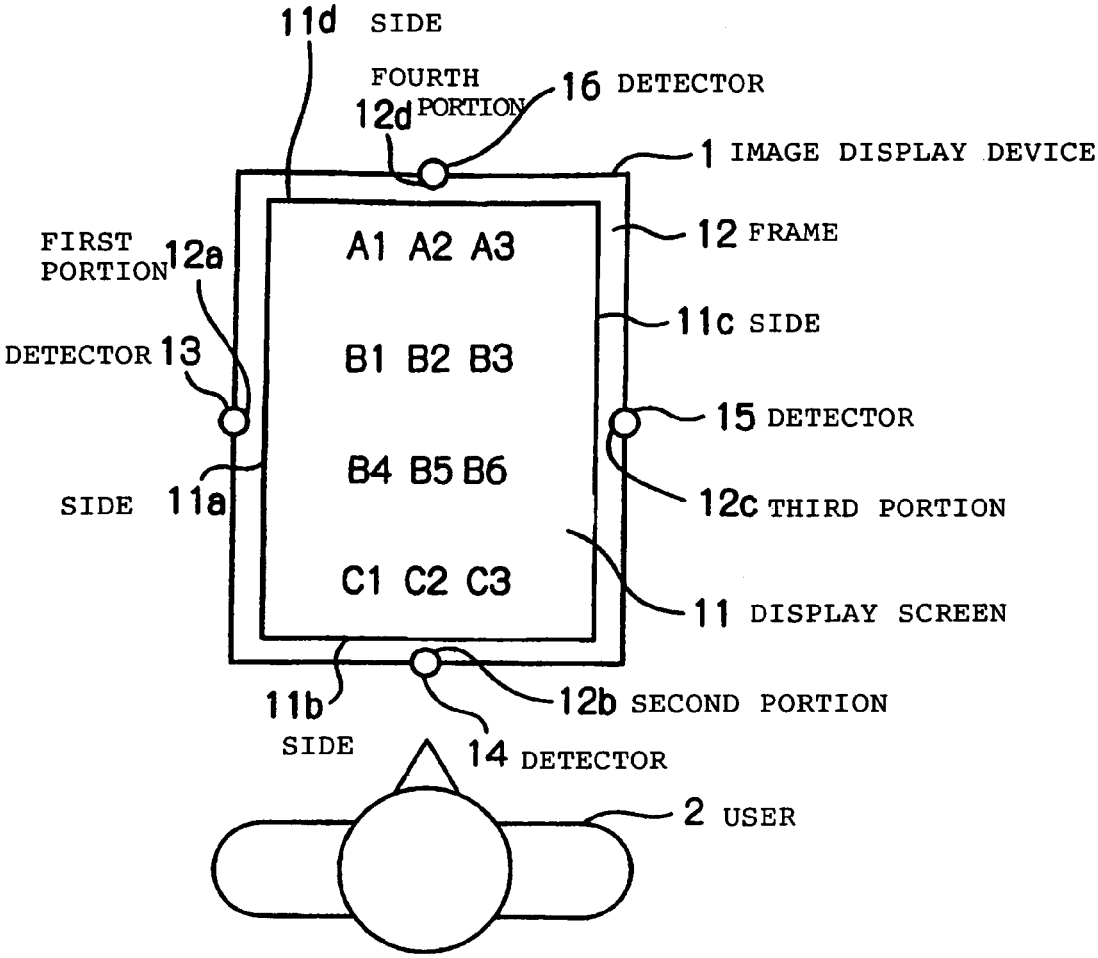
FIG. 4 is a plan view illustrating the image display device according to the embodiment of the present invention.

FIG. 4 is a plan view illustrating a situation in which user 2 recognizes that the image, which is viewed in the state illustrated in FIG. 2, is a document in format with more height than width (for example, a catalog or the like), so that user 2 has rotated image display device 1 by 90 degrees in the counter-clockwise direction. In FIG. 4, components identical to those in FIG. 2 are designated the same reference numerals.

In the state illustrated in FIG. 4, when control circuit 22 operates detectors 13, 14, 15 and 16, detectors 13, 14, 15 and 16 supply control circuit 22 with a first, a second, a third, and a fourth detection signal, respectively.

In the state illustrated in FIG. 4, control circuit 22 selects the second detection signal from the first, second, third, and fourth detection signals. Then, control circuit 22 converts the image signal for display unit 20 such that the bottom of the image is moved to side 11*b* corresponding to detector 14 that has generated the selected second detection signal. Consequently, the image shown in FIG. 2 is rotated by 90 degrees in the clock-wise direction to display an image shown in FIG. 4.

In the state illustrated in FIG. 4, because the image is displayed in format with more height than width on display screen 11, the displayed image is larger than that shown in FIG. 2. Thus, in the state illustrated in FIG. 4, the user can be provided with a more visible image than that shown in FIG. 2.

When detectors 13-16 comprise distance sensors, the following situation will arise.

When image display device 1 is installed on a stand or a floor such that display screen 11 is substantially vertical to the ground surface, the distance, which is indicated by a detection signal generated by a sensor which detects the distance from image display device 1 to the stand or floor, is shorter than the distance indicated by the remaining detection signals.

For this reason, when image display device 1 is installed on a stand or a floor such that display screen 11 is substantially vertical to the ground surface, the bottom of an image is moved to the bottom of display screen 11. Thus, image display device 1 can provide an image that the user can easily watch.

According to this embodiment, image display device 1 can detect a user who exists beside display screen 11. Then, the direction of the image displayed on display screen 11 is controlled based on the result of the detection. Thus, image display device 1 can automatically display on display screen 11 an image that the user can easily watch even if image display device 1 is installed such that display screen 11 is substantially horizontal to the surface ground.

In this embodiment, control circuit 22 detects a side close to the user from the sides that define display screen 11 based on the first, second, third, and fourth detection signals. Control circuit 22 controls the direction of an image on display screen 11 such that the bottom of the image is moved to the detected side. In this way, image display device 1 can automatically display an image that the user can easily watch, in other words, an image corresponding to the direction in which the user is viewing.

This embodiment is particularly effective when image display device 1 is a highly portable thin image display device that utilizes a flat panel. This is because it is anticipated that the highly portable thin image display device, for example, an image display device utilizing a flat panel such as LCD or PDP is often installed and used such that display screen 11 thereof is substantially horizontal to the ground surface. According to this embodiment, even if image display device 1 is used in such a way, image display device 1 automatically displays on display screen 11 an image that the user can easily watch.

It should be understood that in the embodiment described above, the illustrated configuration is a mere example, and the present invention is not limited to that configuration.

For example, while in the foregoing embodiment, four detectors are mounted on frame 12, the number of detectors mounted on frame 12 is not limited to four but can be changed as appropriate. For example, a plurality of detectors may be mounted at locations in close proximity to one side of display screen 11. Alternatively, three detectors may be mounted on frame 12, such that control circuit 22 controls the direction of an image displayed on display screen 11 based on detection signals of the three detectors. For example, one of detectors 13, 14, 15, 16 may be removed in the embodiment illustrated in FIG. 2. Control circuit 22 may control the direction of an image such that the bottom of the image is moved to a side corresponding to a detector that has detected a signal indicative of the shortest distance of the three detection signals generated by the three detectors mounted on frame 12. Further, when all of three detection signals, which are generated by the three detectors mounted on frame 12, indicate distances equal to or longer than a predetermined distance, control circuit 22 controls the direction of an image such that the bottom of the image is moved to a side corresponding to the removed detector.

Figure 1:
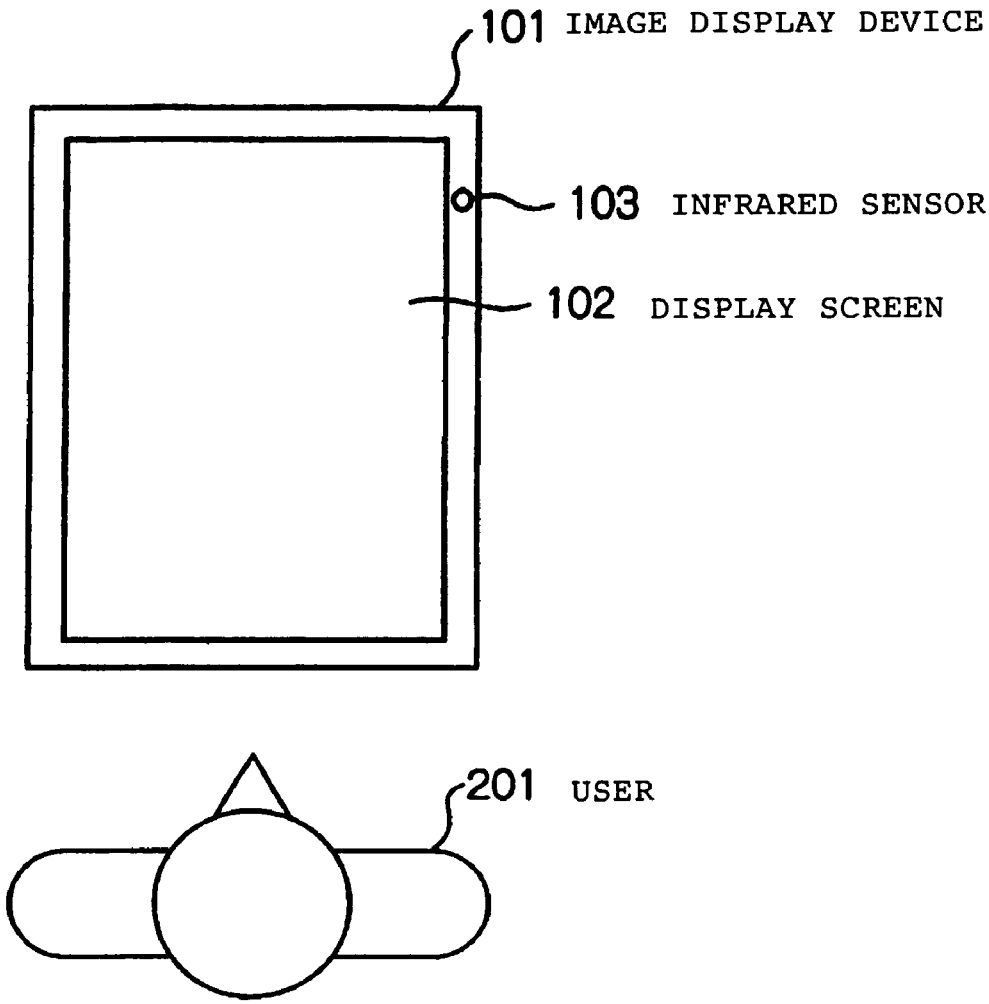
FIG. 1 is a plan view illustrating a conventional image display device.

In the foregoing alternative, the configuration can be simplified because a less number of detectors can be used than in the embodiment illustrated in FIG. 1.

Further alternatively, two detectors may be mounted on frame 12, and control circuit 22 may control the direction of an image displayed on display screen 11 based on detection signals generated by the two detectors.

Figure 5:
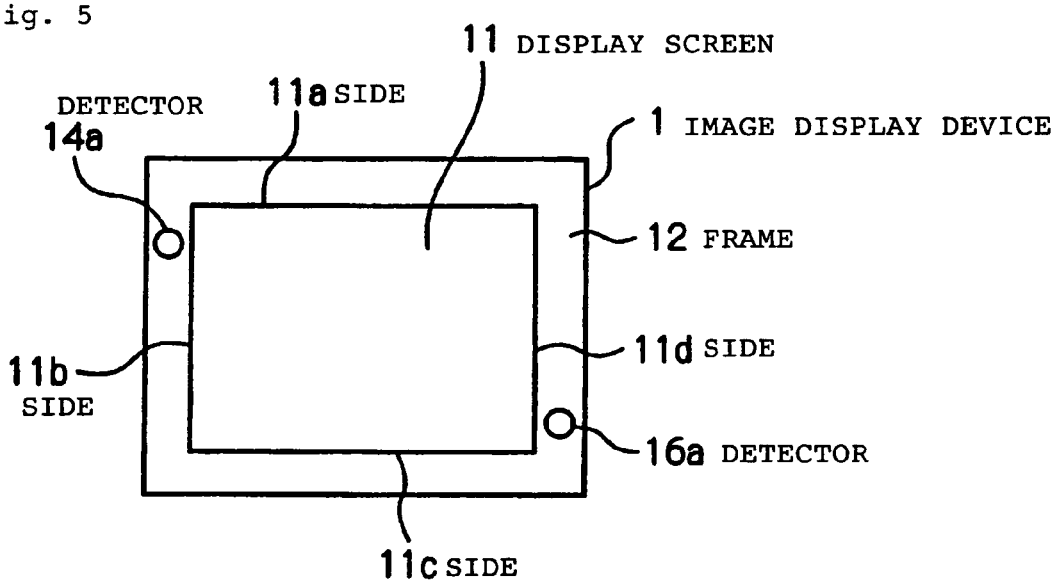
FIG. 5 is a plan view illustrating an image display device according to another embodiment of the present invention.

FIG. 5 is a plan view illustrating an exemplary image display device which has two detectors mounted on frame 12. In FIG. 5, components identical to those shown in FIG. 1 are designated the same reference numerals.

In FIG. 5, detectors 14*a* and 16*a* are mounted on frame 12. Detector 14*a* is mounted at a position on frame 12 by side 11*b* near side 11*a*. Detector 16*a* is mounted at a position on frame 12 by side 11*d* near side 11*c*. Each of detectors 14*a* and 16*a* comprises an infrared sensor that can detect infrared rays radiated from all regions. Alternatively, detectors 14*a* and 16*a* may comprise distance sensors.

Control circuit 22 controls the direction of an image displayed on display screen 11 based on a detection signal generated from detector 14*a* and a detection signal generated from detector 16*a*.

For example, control circuit 22 determines that the user exists a position in close to side 11*a* or 11*b* when the detection signal (output voltage), which is generated from detector 14*a*, is larger than the detection signal (output voltage), which is generated from detector 16*a*. Subsequently, control circuit 22 detects the difference between the detection signal (output voltage) generated from detector 14*a* and the detection signal (output voltage) generated from detector 16*a*. When the difference exceeds a previously set predetermined value, control circuit 22 determines that the user exists near side 11*b*. On the other hand, when the difference does not exceed the previously set predetermined value, control circuit 22 determines that the user exists near side 11*a*.

Control circuit 22 determines that the user exists a position near side 11*c* or 11*d* when the detection signal (output voltage), which is generated from detector 14*a*, is smaller than the detection signal (output voltage), which is generated from detector 16*a*. Subsequently, control circuit 22 detects the difference between the detection signal (output voltage) generated from detector 14*a* and the detection signal (output voltage) generated from detector 16*a*. Controller 22 determines that the user exists near side 11*d* when the difference exceeds a previously set predetermined value. On the other hands, when the difference does not exceed the previously set predetermined value, control circuit 22 determines that the user exists near side 11*c*. Control circuit 22 sets the direction of an image such that the bottom of the image is moved to the side near which the user exists.

In the example illustrated in FIG. 5, the configuration can be simplified because a less number of detectors are required than the embodiment illustrated in FIG. 2.

The positions of detectors 14*a* and 16*a* mounted on frame 12 are not limited to the foregoing ones. The positions of detectors 14*a* and 16*a* mounted on frame 12 can be changed as appropriate as long as respective detectors 14*a* and 16*b* generate different output voltages when the user exists near side 11*a*, 11*b*, 11*c*, or 11*d*.

While preferred embodiments of the present invention have been described using specific terms, such description is for illustrative purposes only, and it is to be understood that changes and variations may be made without departing from the spirit or scope of the following claims.

What is claimed is:

1. An image display device, comprising:

a display unit having a display screen in a rectangular shape which displays an image;

a frame arranged along a periphery of said display screen;

a plurality of detectors mounted on said frame, each of which generates a detection signal in response to a distance to an object positioned outside of said frame; and a controller which controls said image displayed on said display screen based on detection signals generated from respective detectors from among said plurality of detectors, wherein said plurality of detectors comprises three detectors mounted at a location on said frame close to each of three sides among four sides of said display screen, and wherein said controller monitors said detection signals generated from respective detectors from among said plurality of detectors, detects a side, to which any one of said three detectors does not correspond, from among said four sides as a side to which a user is close when all of said detection signals indicate distances equal to or longer than a predetermined distance, under a situation in which said side, to which the user is close, is detected from among said four sides based on a detection signal that indicates a shortest distance among said detection signals, and controls a direction of said image such that a bottom of said image is moved to the detected side.

2. The image display device according to claim 1, wherein each of said detectors comprises a radiant heat sensor which detects an amount of heat radiated from an object in order to generate a signal indicative of the detected amount of radiant heat as the detection signal.

3. The image display device according to claim 1, wherein each of said detectors comprises a distance sensor.

4. The image display device according to claim 1, further comprising an image signal input unit which receives an image signal supplied from an external device through a wire, wherein said controller converts the image signal based on the detection signals generated from said respective detectors in order to control a direction of an image represented by the image signal on said display screen, and displays an image represented by the converted image signal on said display screen.

5. The image display device according to claim 4, further comprising a storing unit which preserves the image signal received by said image signal input unit.

6. The image display device according to claim 5, wherein said storing unit is removable.

7. The image display device according to claim 5, wherein the controller converts the image signal based on the detection signals generated from said respective detectors in order to control a direction of an image represented by the image signal on said display screen.

8. The image display device according to claim 1, further comprising a generator which generates an image signal representative of the image, wherein said controller converts the image signal generated by said generator based on the detection signals generated from said respective detectors in order to control a direction of an image represented by the image signal generated by said generator on said display screen, and displays an image represented by the converted image signal on said display screen.

9. The image display device according to claim 1, further comprising an image signal input unit which receives an image signal supplied from an external device through an antenna, wherein said controller converts the image signal based on the detection signals generated from said respective detectors from among said detectors in order to control a direction of an image represented by the image signal on said display screen, and displays an image represented by the converted image signal on said display screen.

10. The image display device according to claim 1, wherein the controller is connected to an operation board operated by a user, and wherein the operation board receives a variety of inputs indicated by a user's operations.

11. The image display device according to claim 1, wherein the controller comprises:

a control circuit, wherein the control circuit generates an image signal based on entries from a user received by an operation board.

12. The image display device according to claim 11, wherein the control circuit stores the image signal in a storage unit when the user operates said operation board.

13. The image display device according to claim 11, wherein the control circuit converts the image signal based on the detection signals generated from said plurality of detectors in order to control a direction of an image represented by the image signal on said display screen.

14. The image display device according to claim 1, wherein the controller selects a detection signal that indicates a highest output voltage.

* * * * *